US005154198A

United States Patent [19]

Allen

[11] Patent Number: 5,154,198

[45] Date of Patent: Oct. 13, 1992

[54] TUBE JETTING APPARATUS

[75] Inventor: John T. Allen, Duncan, Okla.

[73] Assignee: Halliburton Company, Duncan, Okla.

[21] Appl. No.: 240,906

[22] Filed: Sep. 1, 1988

[51] Int. Cl.[5] ..... B08B 3/02

[52] U.S. Cl. ..... 134/56 R; 134/167 C; 134/172; 91/54

[58] Field of Search ..... 91/47, 51, 49, 54; 92/110, 111, 181 P, 183, 59; 122/390, 391, 392, 405; 134/166 R, 167 C, 169 C, 172, 56 R

[56] References Cited

U.S. PATENT DOCUMENTS

| | | | |
|---|---|---|---|
| 1,128,406 | 2/1915 | Burgess . | |
| 1,982,590 | 11/1934 | Church et al. | 91/44 |
| 1,995,132 | 3/1935 | Snow | 122/392 |
| 2,592,923 | 4/1952 | Lumb | 15/317 |
| 2,696,016 | 12/1954 | De Mart | 15/317 |
| 2,742,879 | 4/1956 | Kieser | 91/49 X |
| 3,023,739 | 3/1962 | Dickson, Jr. et al. | 92/110 X |
| 3,062,192 | 11/1962 | Webb | 91/51 X |
| 3,230,977 | 6/1966 | Mercier | 92/183 X |
| 3,246,847 | 4/1966 | Hammelmann | 239/187 |
| 3,426,655 | 2/1969 | Rumsey | 92/183 |
| 3,661,124 | 5/1972 | Winkin | 122/392 |
| 3,664,310 | 5/1972 | Locke, Sr. et al. | 122/379 |
| 3,701,341 | 10/1972 | Willis, Jr. | 122/392 |
| 3,750,230 | 8/1973 | Reed | 15/317 |
| 3,816,871 | 6/1974 | Karnofsky | 15/317 |
| 3,975,992 | 8/1976 | Cagle | 92/110 X |
| 4,079,701 | 3/1978 | Hickman et al. | 122/382 |
| 4,137,928 | 2/1979 | Sentell | 134/167 C |
| 4,177,539 | 12/1979 | Elting | 15/316 R |
| 4,218,016 | 8/1980 | Freund | 239/186 |
| 4,225,362 | 9/1980 | Sentell | 134/24 |
| 4,273,076 | 6/1981 | Lahoda et al. | 122/382 |
| 4,276,856 | 7/1981 | Dent et al. | 122/382 |
| 4,344,570 | 8/1982 | Paseman | 239/67 |
| 4,445,465 | 5/1984 | Byrd et al. | 122/392 |
| 4,498,427 | 2/1985 | Todd | 122/379 |
| 4,509,409 | 4/1985 | Reeves | 92/181 P |
| 4,527,515 | 7/1985 | Hester, II | 122/392 |

FOREIGN PATENT DOCUMENTS

| | | | |
|---|---|---|---|
| 517803 | 3/1953 | Belgium . | |
| 2162499 | 6/1973 | Fed. Rep. of Germany . | |
| 2162500 | 6/1973 | Fed. Rep. of Germany . | |
| 2445487 | 7/1980 | France . | |
| 7841 | of 1914 | United Kingdom . | |
| 11389 | of 1914 | United Kingdom . | |
| 19270 | of 1914 | United Kingdom . | |
| 333440 | 4/1930 | United Kingdom . | |
| 976840 | 12/1964 | United Kingdom | 134/167 C |
| 1029668 | 5/1966 | United Kingdom . | |

OTHER PUBLICATIONS

Corken International Corporation Bulletin VH100B.
Corken Pump Company Service Manual, p. H102E.
Corken International Corporation Important Instructions IH102A.

*Primary Examiner*—Frankie L. Stinson
*Attorney, Agent, or Firm*—James R. Duzan; Neal R. Kennedy

[57] ABSTRACT

A tube jetting apparatus for cleaning the interior surfaces of tubes such as those in heat exchangers. The jetting apparatus includes a hydraulically actuated lance and piston assembly in a housing. High pressure fluid is directed through ports in the lance and also directed across the piston to actuate the lance and piston assembly while providing high pressure fluid to a jetting nozzle on the lance. The speed of the lance and piston assembly is controlled and jetting action occurs on both the outward and return strokes. On the return stroke, a pressure relief system is provided to relieve the system pressure through a differential pressure relief valve. A stroke limiter is provided which utilizes a collet for grippingly engaging the lance at a predetermined location thereon while minimizing damage to the surface of the lance.

45 Claims, 5 Drawing Sheets

TUBE JETTING APPARATUS

BACKGROUND OF THE INVENTION

1. Field Of The Invention

This invention relates to apparatus for cleaning the interior surfaces of tubes, and more particularly, to a fluid controlled jetting apparatus which jets fluid at high pressure on both an outward stroke and a return stroke of a lance assembly therein and relieves the high pressure at the end of the return stroke.

2. Description Of The Prior Art

Previously known fluid powered jetting apparatus generally fall into one of two categories. In the first category, fluid is pumped to the lance directly. Jetting apparatus of this type are disclosed in U.S. Pat. Nos. 1,982,590 to Church et al., and 3,246,847 to Hammelmann. These devices have the advantage of delivering full pump pressure to the spray head or nozzle on the end of the lance, but they are relatively complex and require close tolerance valving and moving parts with the various wetted areas separated by high maintenance elastomeric seals.

In the other type of previously known fluid powered jetting apparatus, the fluid is fed to the lance indirectly from the piston side of the device. That is, the device acts similar to a hydraulic cylinder. Such an apparatus is shown in U.S. Pat. Nos. 4,137,928 and 4,225,362 to Sentell. These devices have the advantage of requiring only simplified control valving and no close tolerances other than the lance wiper gland separating the rod into the cylinder from the environment. However, they have a disadvantage in that a large percentage of the pressure is consumed as viscous friction losses across the piston before the fluid reaches the lance.

The tube jetting apparatus of the present invention takes advantage of the simplicity of the indirect feed devices, but fluid is fed to the lance from the high pressure lance side of the device rather than the low pressure piston end of the device. Tube jetting apparatus built according to the present invention will have a greater efficiency than prior art devices of the second type already discussed. The present invention also has the advantage of jetting fluid on the return stroke, as well as the outward stroke. An automatic end of cycle pressure release system lowers the pressure on the entire lance nozzle and lance reciprocating system at the end of the return stroke which is generally the only time that an operator must be in close proximity to the apparatus.

In cleaning articles such as heat exchangers with U-bend tubes, the jetting lance must be stopped at a predetermined point to avoid a collision between the lance and the U-bend region of the tube being cleaned. In such a case, it is desired to limit the outward stroke of the jetting lance to a predetermined distance. Generally, a sleeve or plug is attached to the lance itself by a fastening means such as set screws, such as in U.S. Pat. No. 4,344,570 to Paseman, and this sleeve or plug will stop outward motion of the lance when it contacts a shoulder in the apparatus. A problem with such stroke limiting devices is that the set screws must be set very tightly against the surface of the lance to hold the sleeve or plug when it engages the shoulder. Frequently, setting the set screws will damage the surface of the lance, or the sleeve or plug will move slightly which causes the set screw to drag along the surface, again causing damage to the lance. This is a problem if the lance is then later used for longer strokes and this damaged area passes through sealing members.

The jetting apparatus of the present invention solves this problem by providing a mechanical stroke limiter which utilizes a collet means which tightens around and grippingly engages the lance when a collet engaging means contacts a shoulder in the apparatus. A collet support means may be used and is attached to the lance by set screws, but the collet support means absorbs very little axial force. Therefore, it is generally not necessary to tightly engage the set screws with the lance, nor is it likely that the collet support means will move axially along the lance and thereby damage it.

SUMMARY OF THE INVENTION

The tube jetting apparatus of the present invention is adapted for cleaning interior surfaces of tubes and generally comprises housing means for forming an enclosure, housing inlet means on the housing means for defining a fluid inlet therein, housing outlet means on the housing means for defining a fluid outlet therein, piston means for moving inwardly and outwardly in the housing means such that a high pressure or inlet section in communication with the housing inlet means is defined in the housing means on one side of the piston means and a low pressure or outlet section is defined on an opposite side of the piston means, and lance means attached to the piston means for extending from the housing means into a tube aligned therewith. The apparatus further comprises a flow control means for providing high pressure in the lance means and for controlling fluid flow in the housing means, whereby a speed of the piston means and the lance means through the housing means is controlled. Also, the apparatus may comprise pressure relieving means for relieving pressure in the high pressure section as the piston means approaches an end of an inward or return stroke of the piston means and lance means.

The flow control means comprises means for controlling fluid flow from the high pressure section to the low pressure section, whereby the speed of the piston means and lance means is controlled during an outward stroke thereof. The flow control means may be characterized by the piston means defining a piston central opening therethrough, the lance means defining a lance central opening therein in communication with the piston central opening, the lance means further comprising port means providing communication between the lance central opening and the high pressure section, and an orifice disposed in the piston central opening.

The port means is preferably characterized by a plurality of substantially transverse holes or ports in the lance adjacent to the piston means. The cross-sectional area of the port means is preferably greater than the crosssectional area of the lance central opening. In this embodiment, the apparatus further comprises sealing means for sealing between the piston means and the housing means. A plurality of pressure balancing grooves may be defined in an outer surface of the piston means to prevent the piston means from being forced to one side of the housing means.

In another embodiment, the fluid control means is characterized by an annulus defined between the piston means and the housing means.

The flow control means may also comprise means for controlling fluid flow from the low pressure section to a venting location, whereby the speed of the piston means and the lance means is controlled during an inward stroke thereof. In this embodiment, the flow control means may be characterized by venting means connected to the housing outlet means for providing communication between the low pressure section and the venting location. This venting means may include a means for adjusting the flow therethrough, such as a throttling valve therein and also an orifice in communication with the throttling valve. This arrangement is preferably combined with the orifice in the piston so that independent control of the piston means and lance means in both the outward and inward directions is available.

The pressure relieving means may be characterized by an opening or port in the housing means such that the piston means passes the opening at the end of the inward or return stroke such that the opening is placed in communication with the high pressure section. During other portions of the stroke cycle, the opening is in communication with the low pressure section. In this embodiment, a sealing means is provided for sealing between the piston means and the housing means when the piston means is spaced from the pressure relieving means. The housing means defines a housing central opening therein through which the piston means moves, and this housing central opening preferably has an enlarged portion adjacent to the pressure relieving means. Tapered portions are provided on opposite sides of the enlarged portion. As the sealing means passes into alignment with the enlarged portion, the sealing means is substantially disengaged from the housing means. This prevents damage of the sealing means as it passes the opening of the pressure relieving means.

The pressure relieving means is preferably in communication with the housing outlet means, and relief valve means may also be provided for opening in response to a predetermined pressure between the housing inlet means and the housing outlet means. The pressure relief valve of the present invention generally comprises a relief valve housing means for forming an enclosure and having an inlet, an outlet and an equalizing connection. A poppet means is slidably disposed in the housing means for closing the inlet thereof when in a closed position and providing communication between the inlet and outlet when in an open position. The pressure relief valve further comprises biasing means for biasing the poppet means toward the closed position, and means for limiting movement of the poppet means when in the open position. Sealing means may also be provided for sealingly separating the inlet from the equalizing connection of the relief valve housing means. The poppet means preferably has an annularly recessed portion thereon, and the outlet of the relief valve housing means is generally in communication with the recessed portion even when the poppet means is in the closed position.

The tube jetting apparatus of the present invention also comprises a stroke limiting apparatus for limiting the outward stroke of the lance means from the housing means. The stroke limiting apparatus generally comprises collet means for positioning around the lance means at a predetermined position or location thereon, and collet engaging means disposed on the lance means for engaging the collet means when the collet engaging means contacts an end portion of the housing means. In this way, the collet engaging means forces the collet means into gripping engagement with the lance means such that further outward movement of the lance means is prevented. Collet support means may also be provided for holding the collet means at the predetermined position on the lance.

In the preferred embodiment, the collet means is characterized by a collet having a longitudinal slit therein and having a tapered outer surface, and the collet engaging means is characterized by a collet engaging sleeve having a tapered inner surface adapted for engaging the tapered outer surface of the collet such that the collet is deflected substantially radially inwardly when contact is made by the collet engaging sleeve with the end of the housing. The collet support means may be characterized by a collet support sleeve positioned on an opposite side of the collet from the collet engaging sleeve. The collet may have a second tapered outer surface, and the collet support sleeve may have a tapered inner surface therein adapted for engaging the second tapered outer surface of the collet. The collet support means may be attached to the lance means by a fastening means such as a set screw. Preferably, the collet engaging means comprises vent means thereon for preventing a pressure buildup thereacross. In the embodiment having a collet engaging sleeve, the vent means is characterized by at least one longitudinal groove formed in an inner surface of the collet engaging means.

An important object of the present invention is to provide a tube jetting apparatus having flow control means for independently controlling the speed of a lance and piston assembly therein during both outward and inward strokes of the lance and piston assembly.

Another important object of the present invention is to provide a tube jetting apparatus having flow control means for controlling fluid flow across a piston means therein.

A further object of the invention is to provide a fluid jetting apparatus having pressure relieving means for relieving pressure in the apparatus as the piston means therein approaches an end of an inward or return stroke thereof.

Another object of the invention is to provide a fluid jetting apparatus which jets fluid on both the outward and return strokes.

Still another object of the invention is to provide a fluid jetting apparatus wherein fluid is provided to a jetting lance means on a high pressure side of a piston means therein.

An additional object of the present invention is to provide a differential relief valve for use in relieving pressure on a fluid jetting apparatus.

A further object of the invention is to provide a stroke limiting means for a fluid jetting apparatus which utilizes a collet so that damage to the jetting lance means is minimized.

Additional objects and advantages of the invention will become apparent as the following detailed description of the preferred embodiment is read in conjunction with the drawings which illustrates such preferred embodiment.

DESCRIPTION OF THE PREFERRED EMBODIMENT

Figure 1:
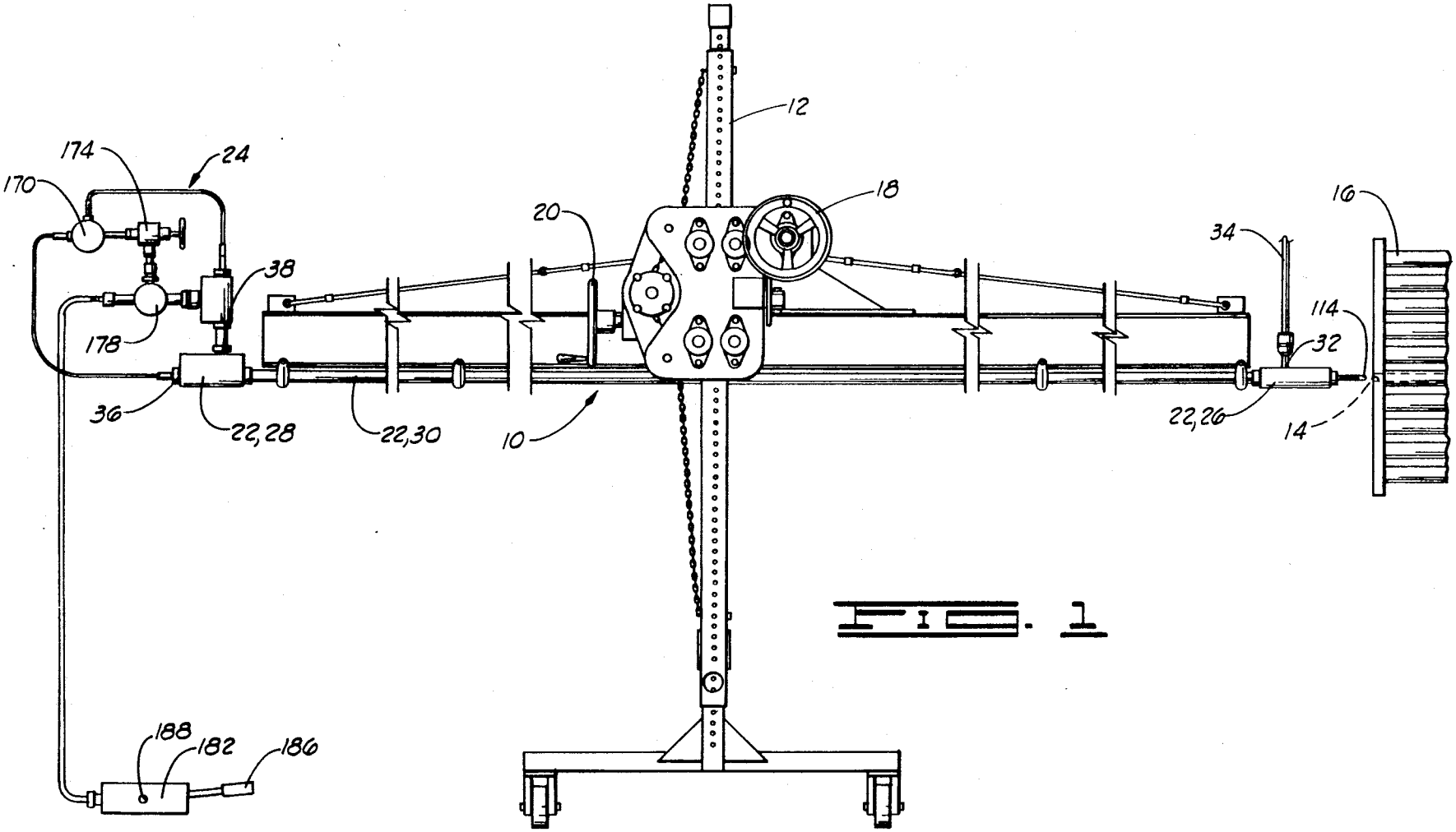
FIG. 1 is a side view of the fluid jetting apparatus of the present invention mounted on a supporting and positioning device.
Figure 2:
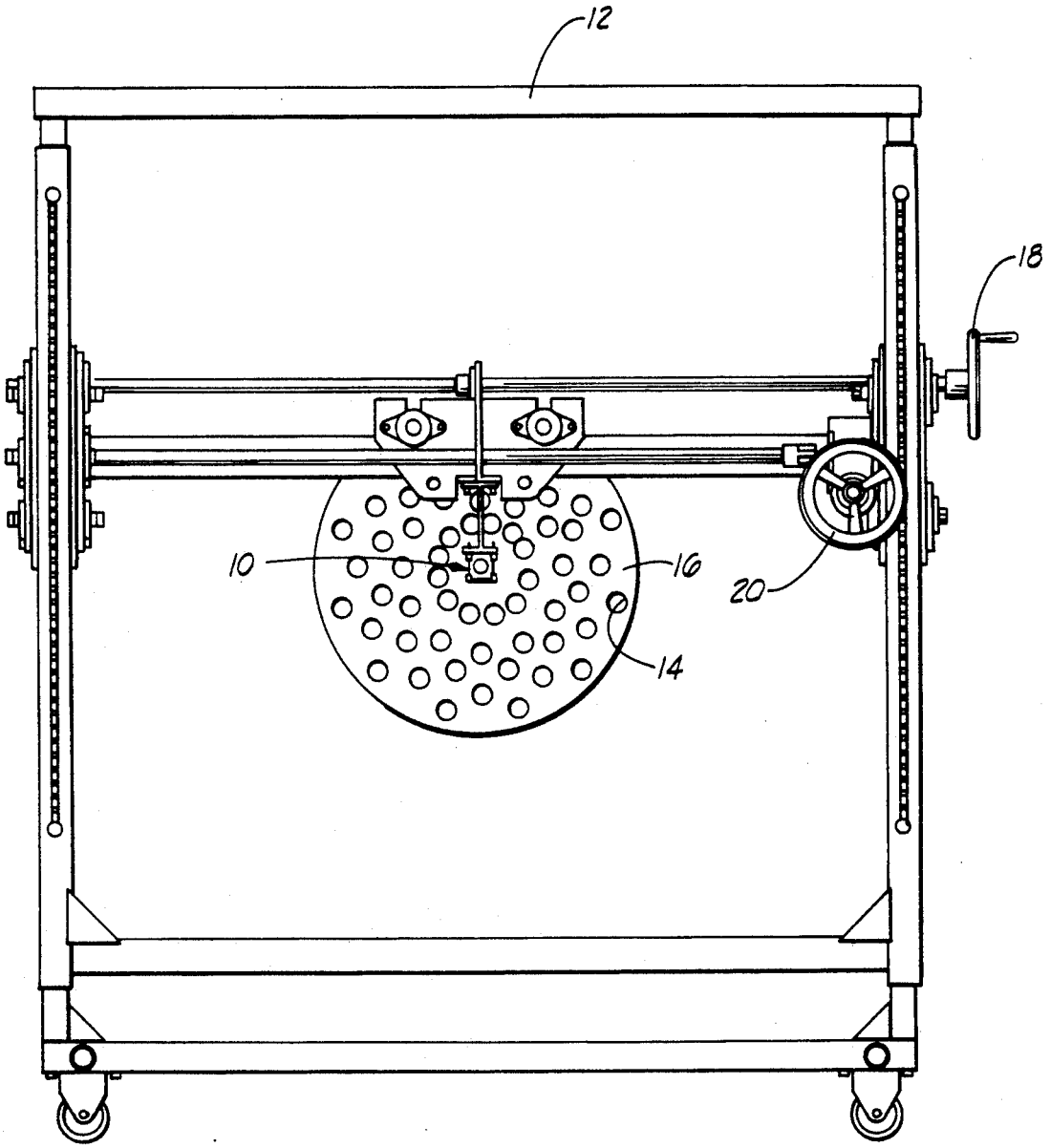
FIG. 2 is an end view of the tube jetting apparatus and supporting device.

Referring now to the drawings, and more particularly to FIGS. 1 and 2, the tube jetting apparatus of the present invention is shown and generally designated by the numeral 10. Jetting apparatus 10 is shown suspended from a supporting and positioning device such as support rack 12. Support rack 12 is of a kind known in the art, and therefore most details thereof will not be discussed in this disclosure. However, it will be understood by those skilled in the art that support rack 12 may be used to position jetting apparatus 10 adjacent to an item to be cleaned, such as any one of tubes 14 of a heat exchanger 16. The vertical position of jetting apparatus 10 may be adjusted by rotating handle 18 of support rack 12 and adjusted horizontally by rotating handle 20 on the support rack. In this manner, jetting apparatus 10 may be precisely aligned with any one of tubes 14.

Jetting apparatus 10 generally comprises a housing 22 and a control manifold assembly 24. Housing 22 comprises an inlet end portion 26 and an outlet end portion 28 interconnected by an elongated tubular portion 30.

Inlet end portion 26 of housing 22 defines a housing inlet means 32 therein. Fluid is pumped to housing 22 through housing inlet means 32 by a pump (not shown) of a kind known in the art through inlet line 34.

Figure 3:
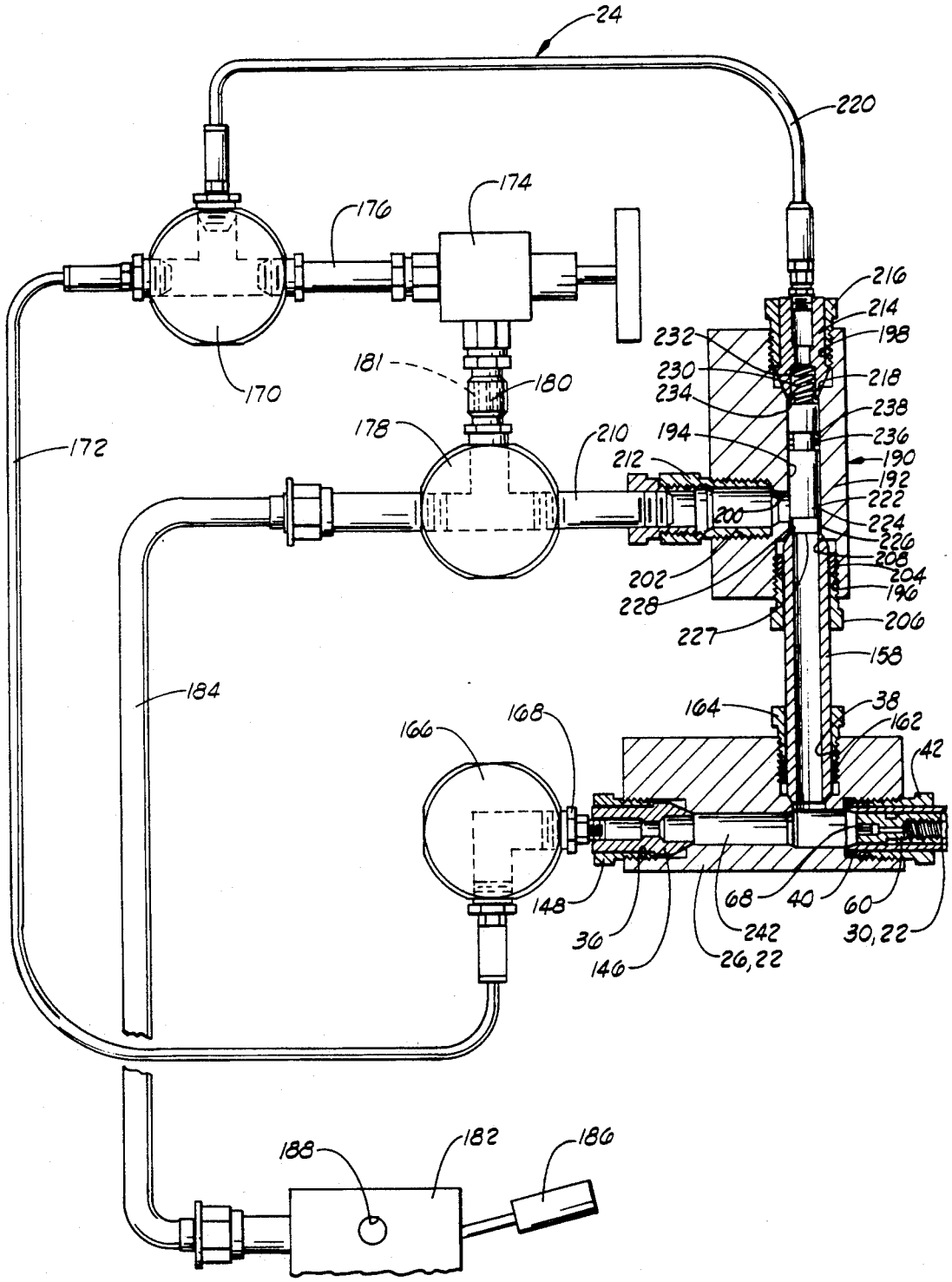
FIG. 3 is a detailed cross-sectional view of the control manifold of the tube jetting apparatus.

Referring now to FIGS. 1 and 3, outlet end portion 28 of housing 22 defines a housing outlet means 36 and a pressure relief or bypass opening 38 therein. Control manifold assembly 24 is connected to housing outlet means 36 and pressure relief opening 38, and details of the control manifold assembly will be further discussed herein.

Figure 4:
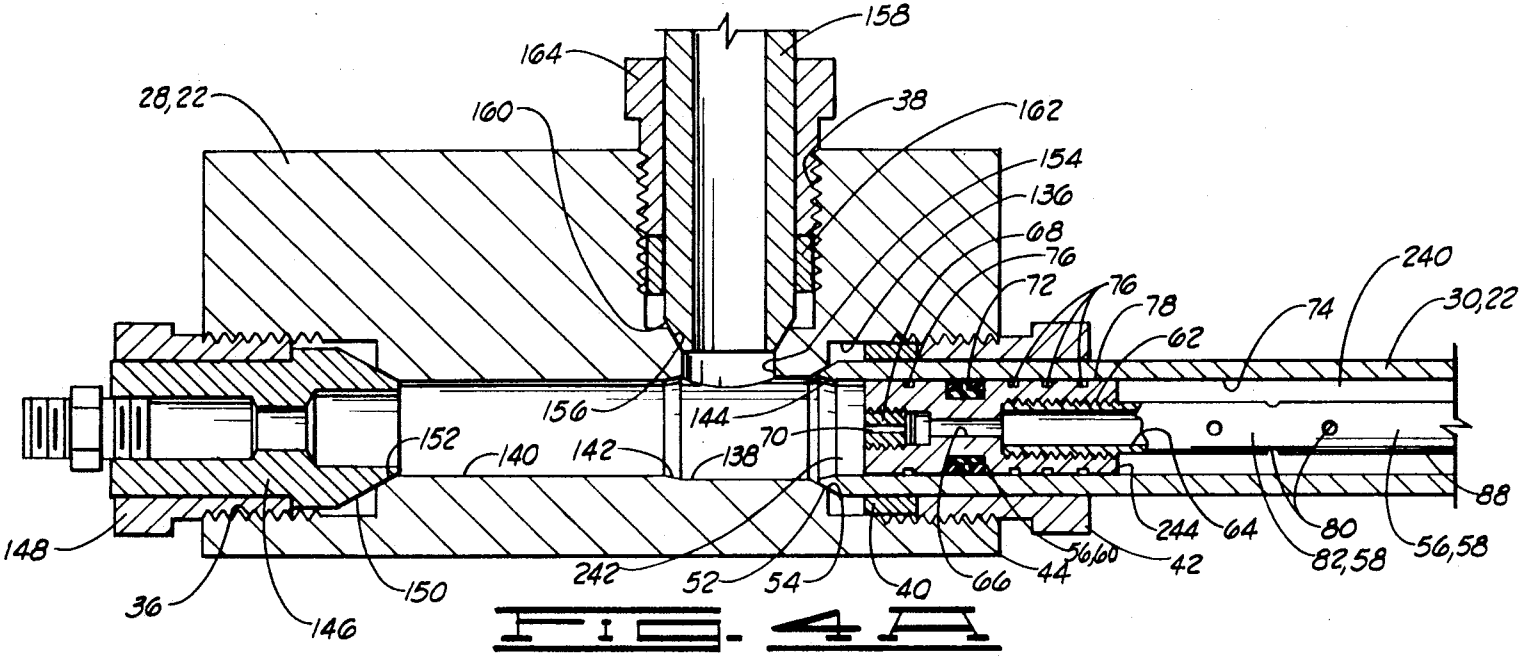
FIGS. 4A and 4B show a longitudinal cross section of the tube jetting apparatus.
Figure 1:
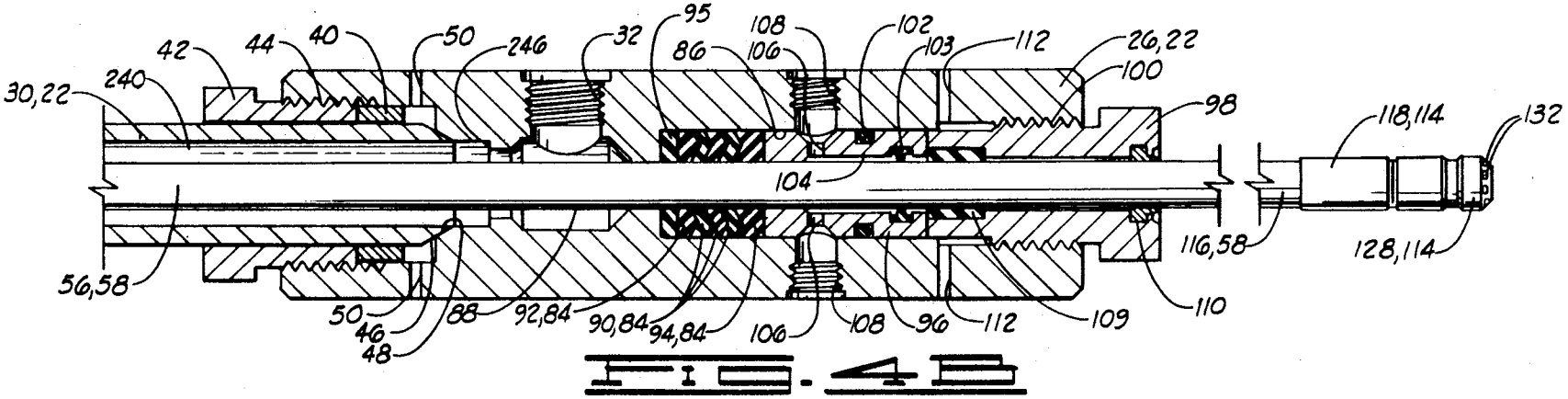

Referring now to FIGS. 4A and 4B, details of housing 22 and the components therein will be discussed. Tubular portion 30 of housing 22, which is preferably substantially cylindrical, is connected at opposite inner and outer ends, respectively, to inlet end portion 26 and outlet end portion 28 by a tube fitting of a kind known in the art which includes a ferrule or collar 40 and a nut or gland 42 which is engaged with the inlet and outlet end portions at threaded connection 44.

Tubular member 30 has a tapered first or outer end 46 generally adapted for sealing engagement with tapered inner surface 48 in outlet end portion 26. In the event of slight leakage past this metal-to-metal connection, at least one vent hole 50 is provided in inlet end 26 to prevent a pressure buildup acting outwardly on ferrule 40 and nut 42.

Second or inner end 52 of tubular portion 30 similarly has a tapered surface generally adapted for sealing engagement with tapered inner surface 54 of outlet end portion 28.

Housing 22 thus generally defines a housing means for enclosing a jetting lance and piston assembly 56. Lance and piston assembly 56 comprises a lance means, generally in the form of an elongated jetting lance 58, for extending from housing 22 and a piston means, generally characterized by a substantially cylindrical piston 60, for moving inwardly and outwardly within housing 22. Lance 58 is attached to piston 60 at threaded connection 62.

Lance 58 defines a lance central opening 64 therethrough which is substantially aligned with a piston central opening 66 in piston 60. Threadingly engaged with piston 60 in central opening 66 thereof is an orifice 68 with a predetermined orifice opening 70 therethrough. As will be discussed further herein, orifice 68 may be interchanged with other orifices with different size orifice openings.

Sealing means, such as piston seal 72, may be provided for sealing between piston 60 and inner surface 74 of tubular member 30 of housing 22. Pressure relief grooves 76 may be cut into outer surface 78 of piston 60 to lessen the likelihood that fluid pressure could force piston 60 radially against inner surface 74 of tubular member 30.

Lance 58 comprises port means therein, such as a plurality of spaced, transverse holes or ports 80 in an inner end 82 of the lance adjacent to piston 60. It will be understood that ports 80 are in communication with central opening 64 of lance 58. Preferably, the total crosssectional area of ports 80 is greater than the crossectional area of lance central opening 64.

Referring now to FIG. 4B, it will be seen that lance 58 extends through and outwardly from inlet end portion 26 of housing 22. A sealing means 84 is positioned in bore 86 of inlet end portion 26 for providing sealing engagement between and outer surface 88 of lance 58. Sealing means 84 is preferably a high pressure sealing means of a kind known in the art comprising a plurality of V-rings 90, with a male ring 92 and a female ring 94 on opposite sides thereof.

An inner bearing 95 is positioned axially inwardly from packing means 84 in inlet end portion 26 of housing 22. Inner bearing 95 provides a means for guiding and supporting lance 58.

Positioned adjacent to sealing means 84 on the opposite side thereof from inner bearing 95 is a seal support or packing gland 96. A packing nut 98 is engaged with inlet end portion 26 of housing 22 at threaded connection 100 and is used to clamp packing gland 96 against sealing means 84. Another sealing means, such as 0-ring 102, provides sealing engagement between packing gland 96 and bore 86 of inlet end portion 26. Still another sealing means, such as lubricant seal 103 provides sealing engagement between packing gland 96 and outer surface 88 of lance 58. Packing gland 96 has a bore 104 therethrough with at least one transverse hole 106 in communication therewith. Holes 106 are in communication with threaded openings 108 in inlet end portion 26. Lubricant is introduced through openings 108 and holes 106 into bore 104 to cool and lubricate packing means 84. Loss of lubricant is prevented by the sealing means of 0-ring 102 and lubricant seal 103.

An outer bearing 109 is positioned in packing nut 98 axially outwardly from packing gland 96. As with inner bearing 95, outer bearing 109 provides a means for guiding and supporting lance 58. Both inner bearing 95 and outer bearing 109 are preferably sleeve-type bearings adapted for preventing any side loading of lance 58, and thus preventing subsequent damage, caused by such side loading, to packing means 84, packing gland 96 or lubricant seal 103.

A wiper 110 in the outermost end of packing nut 98 sealingly engages outer surface 88 of lance 58. Wiper 110 acts to prevent entry of dust or debris into the area around packing means 84 and bearings 95 and 109.

In the event of minor leakage past packing means 84 and lubricant seal 103, at least one vent hole 112 is provided in inlet end portion 26 of housing 22 to prevent a pressure buildup on nut 98.

Figure 5:
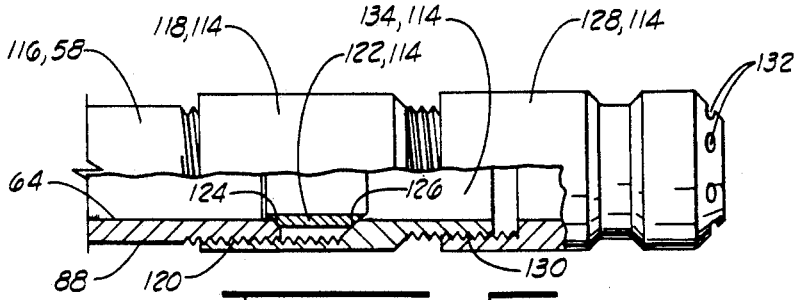
FIG. 5 is a detail of a jetting nozzle.

A jetting nozzle assembly 114 is connected to an outer end 116 of lance 58. Referring now to FIG. 5, it will be seen that jetting nozzle assembly 114 comprises an adapter 118 attached to lance 58 at threaded connection 120. A compression seal 122 provides sealing engagement against chamfered surface 124 on lance 58 and chamfered surface 126 in adapter 118. A jetting nozzle 128 is attached to adapter 118 at threaded pipe connection 130. The size of the tubing from which lance 58 is made does not always make it possible for the use of tapered, self-sealing threads, such as a pipe thread thereon. Thus, the adapter arrangement using adapter 118 and compression seal 122 provides a means for fluid-tight sealing with a threaded coupling on such tubing sizes. It will also be seen that this provides a means for attaching a jetting nozzle 128 having a standard tapered pipe thread to the tubing of lance 58 which may be of non-standard pipe dimensions.

Jetting nozzle 128 is of a kind generally known in the art and includes a plurality of jetting orifices 132 therein. Nozzles 132 are in communication with central opening 134 in jetting nozzle assembly 114, and therefore is in fluid communication with central opening 64 of lance 58.

Referring again to FIG. 4A, outlet end portion 28 of housing 22 has a first bore 136 which extends between chamfered surface 54 therein and threaded connection 44, a second bore 138, and a third bore 140. Third bore 140 is substantially the same diameter as inner surface 74 of tubular member 30 of housing 22, and second bore 138 is enlarged with respect to third bore 140, and preferably is larger than the free outside diameter of piston seal 72 on piston 60. A tapered surface 142 extends between second bore 138 and third bore 140. A similar tapered surface 144 is provided in the end of tubular member 30, and it will be seen that tapered surface 144 generally provides a transition between inner surface 74 of tubular member 30 and second bore 138 of outlet end portion 28 of housing 22. Viewing housing 22 as a single unit, inner surface 74 and third bore 140 may be referred to as first and second portions of the outlet end of housing 22 on opposite sides of enlarged third diameter portion 138.

It will be seen that third bore 140 of outlet end portion 28 of housing 22 is in communication with housing outlet means 36. Positioned in housing outlet means 36 is a connector assembly of a kind known in the art having a plug 146 held in place by a nut or gland 148. Preferably, nut 148 is identical to nut 42. Plug 146 has a tapered surface 150 adapted for sealing engagement with a corresponding tapered inner surface 152 in outlet end portion 28 of housing 22.

Outlet end portion of housing 22 also defines a transverse bore or opening 154 forming part of pressure relief opening 38. Transverse bore 154 intersects enlarged second bore 138, and thus is aligned with second bore 138.

Extending from transverse bore 154 is a tapered surface 156. A nipple 158 is positioned in pressure relief opening 38 such that a tapered surface 160 thereof is in sealing engagement with tapered surface 156 in outlet end portion 28 of housing 22. Nipple 158 is held in place by a ferrule or collar 162 and a nut or gland 164. Preferably, ferrule 162 and nut 164 are substantially identical to ferrule 40 and nut 42, respectively.

Referring now to FIG. 3, the details of control manifold assembly 24 will be discussed. While specific fittings are shown and described for the purposes of this disclosure, it will be seen by those skilled in the art that other piping and tubing arrangements will also be satisfactory, and the invention is not intended to be limited to the specific pipe and tubing arrangement shown.

A branch of high pressure elbow 166 is connected to plug 146 by an adapter 168. The other branch of elbow 166 is connected to one side of the run of a high pressure tee by line 172. The other end of the run of tee 170 is connected to one side of a throttling valve 174 by a line 176. Throttling valve 172 is of a kind known in the art, such as a needle valve.

The other side of throttling valve 174 is connected to the cross of a second tee 178 by orifice holder 180. Orifice holder 180 is adapted for holding an orifice 181 of a kind known in the art. It will be seen that orifice 181 thus restricts the flow between tee 178 and throttling valve 174.

One end of the run of tee 178 is connected to a foot valve 182 by a line 184. Foot valve 182 is of a kind known in the art and has a pedal 186 and a vent opening 188. Vent opening 188 is normally open until foot valve 182 is closed by actuating pedal 186. Opening 188 is open to a venting location, such as the atmosphere or a reservoir (not shown) whenever pedal 186 is not depressed.

In the preferred embodiment, the isolating differential pressure relief valve of the present invention, generally designated by the numeral 190, forms a part of control manifold assembly 24.

Relief valve 190 comprises a relief valve housing means, such as body 192. Body 192 defines a bore 194 therethrough. At one end of bore 194 is an inlet opening 196, and at the other end of bore 194 is a non-atmospheric reference pressure opening 198. Bore 194 is intersected by transverse bore 200 which is aligned with, and in communication with, outlet opening 202. Inlet 196 and outlet 202 are preferably adjacent to one another.

As already discussed herein, one end of nipple 158 is connected to outlet end portion 26 of housing 22. The other end of nipple 158 is positioned in inlet 196 and connected to body 192 in substantially the same manner. That is, a ferrule or collar 204 and a nut or gland 206 connect nipple 158 to body 192. Nipple 158 sealingly engages tapered surface 208 in body 192.

Outlet 202 is connected to an end of the run of tee 178 by line 210 which includes adapter 212. Thus, it will be seen that outlet 202 of relief valve 190 is in communication with foot valve 182.

Positioned in reference pressure opening 198 of body 192 is a plug 214 held in place by a nut or gland 216. Plug 214 and nut 216 are preferably substantially identical to plug 146 and nut 148 which are connected to outlet end portion 26 of housing 22. Plug 214 is sealingly engaged with tapered surface 218 in body 192. Plug 214, and thus reference pressure opening 198 of body 192, is connected to the cross of tee 170 by line 220. Thus, it will be seen by those skilled in the art that reference pressure opening 198 of relief valve 190 is in communication with housing outlet means 36 of housing 22.

Slidably disposed in bore 194 of relief valve housing 192 is a poppet means for sealingly enclosing the inlet of relief valve 190 and a biasing means for biasing the poppet means toward the inlet. In the preferred embodiment, the poppet means is characterized by an elongated poppet 222 having first cylindrical portion or outside diameter 224 in close, spaced relationship to bore 194 in body 192 and a second, smaller cylindrical portion or outside diameter 226 which may also be referred to as a recessed portion of poppet 222. Recessed portion 226 has an end 227 which acts as a seat for sealingly engaging seat end 228 of nipple 158, thereby closing inlet 196.

The biasing means in relief valve 190 is preferably characterized by a spring 230 which engages a shoulder 232 in plug 214 and bears against the end of poppet 222 for biasing the poppet toward seat end 228 of nipple 158. Plug 214 has a stop end 234 facing poppet 222, and as will be further discussed herein, provides a means for limiting movement of poppet 222 in body 192.

Poppet 192 may further comprise a seal groove 236 in which may be disposed a sealing means 238 adapted for providing sealing engagement between poppet 222 and bore 194 in body 192.

A study of relief valve 190 in FIG. 3 will show that outlet 202 is in communication with second outside diameter 226 of poppet 222, even when poppet 222 is in the closed position shown. It will also be seen that body 192 of relief valve 190 may be a component substantially identical to outlet end portion 26 of housing 22, but it is not intended that the invention be limited to such a configuration.

Still referring to FIG. 3, tees 170 and 178 are seen to be in communication with one another, but any flow rate therethrough may be controlled by throttling valve 174 as desired.

OPERATION OF THE INVENTION

After jetting apparatus 10 has been mounted on support rack 12 and adjusted thereby to be in alignment with a particular tube 14 in a device such as heat exchanger 16, the operator begins the jetting operation by activating the pump which pumps fluid through line 34 into housing inlet means 32 and depressing pedal 186 to close foot valve 182. Referring again to FIGS. 4A and 4B, it will be seen that the high pressure fluid pumped into housing inlet means 132 enters an inlet or high pressure fluid section 240 which is to the right or outward side of piston 60 as seen in the drawings. To the left or inward side of piston 60 is an outlet or low pressure fluid section 242.

Assuming that jetting lance and piston assembly 56 is in the position shown in FIGS. 4A and 4B, it is essentially at the beginning of an outward stroke. Fluid pumped into high pressure section 240 enters ports 80 in lance 58 and is directed through lance central opening 64 so that high pressure fluid is delivered to orifices 132 and jetting nozzle 128. Because the total area of parts 80 is greater than that of lance central opening 64, ports 80 do not restrict flow through lance 58. In this way, substantially full high pressure is used to jet the interior of tube 14.

Fluid in central opening 64 of lance 58 also enters central opening 66 in piston 60, and it will be seen that this high pressure fluid passes through orifice opening 70 in orifice 68. Thus fluid enters low pressure section 242 in housing 22. The various components are sized such that the force exerted by the low pressure fluid in low pressure section 242 acting on the area of the left or inward side of piston 60 is greater than the force exerted by the high pressure fluid acting on the annular area on the right or outward side of piston 60 defined by the difference between inside diameter 74 of tubular portion 30 minus the outside diameter 88 of lance 58. It will thus be seen that an outward force is exerted on jetting lance and piston assembly 56 so that it moves to the right or outwardly with respect to housing 22. Thus, jetting orifices 132 are directed along the interior surface of tube 14 as lance 58 extends out of housing 22 and into tube 14.

Orifice 68 is selected such that its orifice opening 70 is of a size sufficient to provide adequate fluid flow from high pressure section 240 into low pressure section 242 while preventing a rocket-like effect which would cause lance and piston assembly 56 to move more quickly than desired on the outward stroke. The outward movement of lance and piston assembly 56 ceases when end 244 of piston 60 contacts shoulder 246 in inlet end portion 26 of housing 22.

It will thus be seen that jetting apparatus 10 comprises a flow control means for providing high fluid pressure in the lance means and for controlling fluid flow from the high pressure section in the housing means to the low pressure section, whereby the speed of the piston means and the lance means through the housing means is controlled on an outward stroke.

As an alternate embodiment, the flow control means may be characterized by an annulus defined between piston 60 and inner surface 74 of tubular portion 30 of housing 22. By properly sizing piston 60, such an annulus could be used in place of orifice 68. In such a configuration, piston 60 would not need a central opening 66 therethrough, and, of course, would not have O-ring 72 on the outer portion thereof.

Once the limit of the outward stroke of lance and piston assembly 56 is reached, the operator may reverse the movement thereof by releasing pedal 186 on foot valve 182 which opens line 184 to vent opening 188. The pressure in line 184, and thus the pressure in all other portions of control manifold assembly 24, is thereby reduced. This, of course, reduces the fluid pressure in low pressure section 242, and this reduction is sufficient so that the force of the fluid pressure acting outwardly on the piston is less than the high pressure fluid in high pressure section 240 acting inwardly on the previously discussed annular area of piston 60 so that lance and piston assembly 56 is forced to the left or inwardly as shown in FIGS. 4A and 4B.

The speed of lance and piston assembly 56 in the inward direction during the return stroke is controlled by throttling valve 174 and orifice 181. That is, fluid flowing out of low pressure section 242 on the inward side of lance and piston assembly 56 is restricted by the opening through throttling valve 174 and the size of orifice 181. Throttling valve 174 is a standard needle valve, and it will be seen by those skilled in the art that orifice 181 defines the maximum flow opening through throttling valve 174 and orifice 181. Thus, orifice 181 sets the maximum retraction speed of lance and piston assembly 56 on its return stroke. However, preferably, this speed may be reduced and adjusted by partially closing throttling valve 174 such that it provides a greater restriction than orifice 181. Orifice 181 basically acts as a backup device to prevent excessive speed of lance and piston assembly 56 on the return stroke in the event that throttling valve 174 is opened too far.

Because high pressure fluid is maintained by the pump in high pressure section 240, it will be seen that substantially full fluid pressure is maintained to jetting nozzle 128 so tube 14 is jetted during the return or inward stroke of lance and piston assembly 56.

It will thus be seen that jetting apparatus 10 comprises a flow control means for providing high pressure fluid in the lance means and for controlling fluid flow from the low pressure section, whereby the speed of the piston means and the lance means through the housing means is controlled on a return stroke. This control means comprises a venting means for providing communication between the low pressure section and a venting location and also comprises means for adjusting the flow through the venting means.

By referring again to FIG. 3, it will be seen to this point that the fluid pressure in low pressure section 242 will be the fluid pressure on both ends of poppet 222 and relief valve 190 because of the arrangement of control manifold assembly 24. Thus, the pressure on poppet 222 is equalized, and spring 232 will keep poppet 222 in the closed position. If this pressure were not equalized, fluid would pass through isolating differential pressure relief valve 190 and would thus bypass orifice 181 and throttling valve 174. If this occurred, the control of the speed of lance and piston assembly 56 on the return stroke would be lost, and if the speed were uncontrolled, damage could occur.

As lance and piston assembly 56 moves inwardly, it will again reach the point shown in FIGS. 4A and 4B, but will continue to move to the left or toward housing outlet means 36. As piston 60 passes bore 154 and pressure relief opening 38 in outlet end portion 28 of housing 22, it will be seen that high pressure section 240 is placed in communication with nipple 158 and thus in communication with inlet 196 of relief valve 190 while reference pressure port 198 in relief valve 190 is still in communication with low pressure section 242. When this occurs, the high pressure fluid overcomes the combination of the forces exerted by spring 230 and the reference pressure on top of poppet 222 in relief valve 190, and thus forces poppet 222 to move open until it hits stop end 234 of plug 214 so that the high pressure fluid is relieved through relief valve housing outlet 202 to foot valve 182. This reduction in pressure will also result in a reduction in pressure at jetting orifices 132 so that the jetting action is greatly reduced at the end of the return stroke of lance and piston assembly 56. Thus, as jetting nozzle 128 exits tube 14, the fluid sprayed therefrom is lessened. This is desirable so that undesired fluid spray is avoided and also so that the high system pressure is relieved at the end of the cycle when the operator must be present.

At all times, non-atmospheric reference pressure port 198 is preferably sealingly separated and isolated from inlet 196 and outlet 202 of relief valve 190 by sealing means 238. This insures the proper combination of highly restricted flow to foot valve 182 during the return motion of lance and piston assembly 56 and substantially unrestricted pressure relief once piston 56 comes to rest in outlet end portion 26 of housing 22 at the end of the return stroke.

It will be seen that relief valve 190 will open because of the differential pressure acting across poppet 222. Because of the setting of throttling valve 174 and the pressure drop across seat portion 227 of poppet 222, the high pressure fluid will keep the poppet in its open position. It should also be noted that as soon as the poppet opens, the cross-sectional area upon which the pressure acts across the poppet is that of bore 194 in body 192, rather than the inside of nipple 158. This insures that once poppet 222 starts to open, it will open fully.

When the pressure is relieved through bypass valve 190, it will be seen that the pressure acting to the left or inwardly on piston 60 is greatly reduced which slows down its movements so that it does not impact plug 146 in a destructive manner. Thus, a pressure relieving means is provided for relieving pressure in the high pressure section as the piston means approaches an end of an inward stroke of the piston means and lance means.

Again referring to FIG. 4A, it will be seen that as piston 60 moves toward outlet means 36, the squeeze on piston seal 72 is gradually relieved as the piston seal passes through tapered surface 144 on tubular portion 30 of housing 22. As previously indicated, the diameter of second bore 138 is preferably greater than the free outside diameter of piston seal 72 so that as the piston seal passes through second bore 138, and particularly as it passes by transverse bore 154, the piston seal will not be damaged. At the very end of the return stroke, piston 60 enters third bore 140 in outlet end portion 28 of housing 22, and piston seal 72 will be gradually squeezed as it passes through tapered surface 142. On the outward stroke of lance and piston assembly 56, this sequence is reversed. Thus, a means is provided for preventing damage to the sealing means of piston seal 72 as the piston means passes the pressure relieving means in housing 22.

At the end of the return stroke, the operator may then depress pedal 186, again closing vent opening 188. The pressure in control manifold assembly 24 will then again be equalized so that poppet 222 and relief valve 190 will reclose. At this point, the pressure in high pressure section 240 will again increase as a result of fluid being fed from the pump, and the operation begins again. It should be noted that prior to restarting the cycle, the operator may reposition jetting apparatus 10 to align it with another tube 14, or the operator may again jet the same tube.

The above-described operation is applicable when the length of lance 114 is less than a straight portion of tube 14 or if tube 14 is a straight tube open at both ends. However, many heat exchangers are constructed with U-bend tubes having two straight portions integrally connected by a curved or U-bend portion. Obviously, lance 58 is not adapted to work in any other portion of the tube except a straight portion, so there are occasions when the outward stroke of lance 58 must be limited so that it does not collide with the U-bend region of a tube in the event that the lance is longer than the straight portion of the tube.

Figure 6:
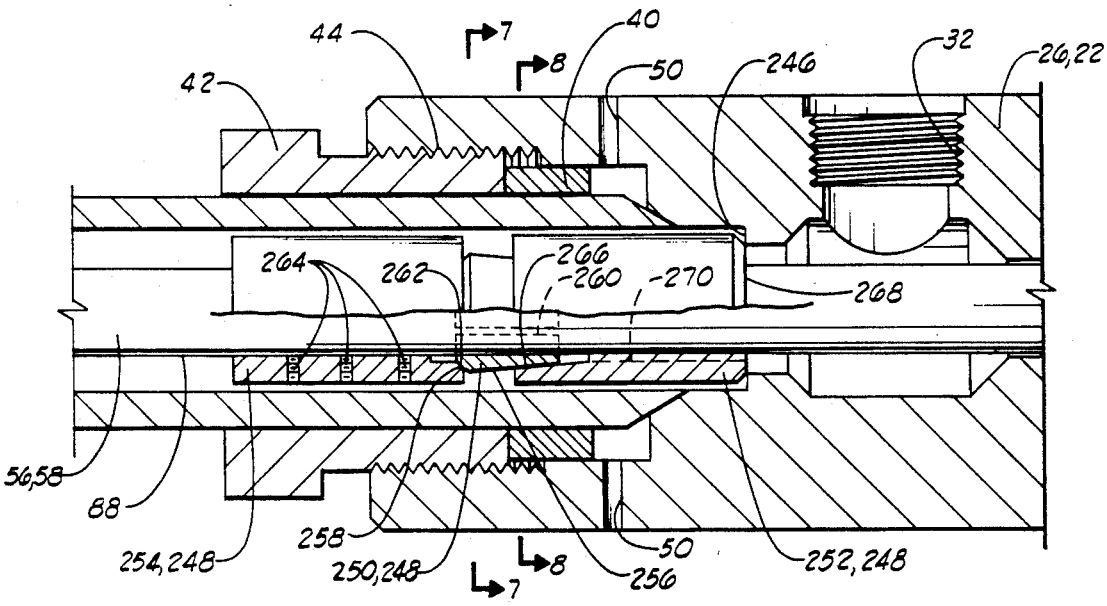
FIG. 6 is a detailed cross section showing a stroke limiting device attached to the jetting lance.

Referring now to FIG. 6, the jetting apparatus stroke limiter of the present invention is shown and generally designated by the numeral 248. Stroke limiter 248 comprises a collet means for positioning around lance 58 at a predetermined position thereon and collet engaging means disposed on the lance for engaging the collet means when desired. The collet means is preferably characterized by a collet 250, and the collet engaging means is preferably characterized by a collet sleeve 252. Collet support means, such as collet support sleeve 254, may also be provided for holding the collet means at the predetermined position on lance 58.

Figure 7:
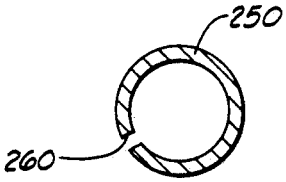
FIG. 7 is a partial cross section taken along lines 7—7 in FIG. 6.

Collet 250 has a first tapered outer surface 256 and a second tapered outer surface 258, relatively shorter than first tapered surface 256. Referring also to FIG. 7, collet 250 has a longitudinal slit therein.

Collet support sleeve 254 has a tapered inner surface 262 corresponding to, and adapted for engagement with, second tapered surface 258 of collet 250. Collet support sleeve 254 may be attached to lance 58 by fastening means, such as a plurality of set screws 264.

Figure 8:
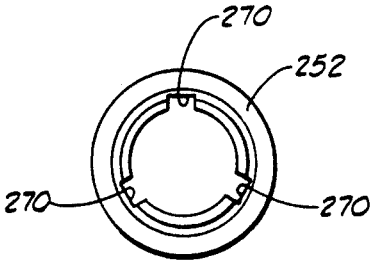
FIG. 8 is a partial cross section taken along lines 8—8 in FIG. 6.

Collet engaging sleeve 252 has a tapered inner surface 266 corresponding to, and adapted for engagement with, first tapered surface 256 of collet 250. Collet engaging sleeve 252 has an end 268 opposite tapered surface 266. Referring also to FIG. 8, collet engaging sleeve 252 has a vent means thereon, characterized in the preferred embodiment by at least one longitudinal slot 270.

When it is desired to use stroke limiter 248 to limit the stroke of lance and piston assembly 56, the stroke limiter is positioned at the appropriate location on lance 58. Set screws 264 in collet support sleeve 254 are tightened, and collet 250 and collet engaging sleeve 252 are positioned adjacent thereto. As lance and piston assembly 56 moves outwardly, end 268 of collet engaging sleeve 252 will be brought into contact with shoulder 246 in inlet end portion 26 of housing 22. At this point, the engagement of tapered surface 266 in collet engaging sleeve 252 with first tapered surface 256 on collet 250 forces the collet to be deflected substantially radially inwardly so that it grippingly engages outer surface 88 of lance 58. Collet support sleeve 254 prevents collet 250 from sliding until this gripping engagement occurs, and once the gripping engagement occurs, collet 250 absorbs essentially all of the axial load acting on lance and piston assembly 56 so that further outward movement thereof is prevented. Slots 270 in collet engaging sleeve 252 and slit 260 in collet 250 insure that no pressure buildup may occur across collet engaging sleeve 252 as a result of any possible sealing between end 268 thereof and shoulder 246 in inlet end portion 26 of housing 22.

Because set screws 264 which hold collet support sleeve 254 are merely used to locate the collet support sleeve and hold collet 250 until the gripping engagement thereof occurs, very little axial load is applied to the set screws, thus minimizing the possibility of set screws 264 and collet support sleeve 254 moving axially along lance 58 which could damage outer surface 88 thereof. Thus, stroke limiter 248 may be repositioned as desired and any portion of outer surface 88 of lance 58 against which the stroke limiter was previously positioned will still have a smooth surface so that it cannot damage sealing means 84 if such area of outer surface 88 passes through sealing means 84 at a later time.

It will be seen, therefore, that the tube jetting apparatus, differential pressure relief valve and stroke limiter of the present invention have attained the ends and advantages mentioned as well as those inherent therein. While a presently preferred embodiment of the invention has been described for the purposes of this disclosure, numerous changes in the arrangement and construction of parts may be made by those skilled in the art. All such changes are encompassed within the scope and spirit of the appended claims.

What is claimed is:

1. An apparatus for cleaning interior surfaces of tubes, said apparatus comprising:

housing means for forming an enclosure;

housing inlet means on said housing means for defining a fluid inlet therein;

piston means for moving in said housing means such that a high pressure section in communication with said housing inlet means is defined in said housing means on one side of said piston means and a low pressure section is defined on an opposite side of said piston means;

lance means attached to said piston means for extending from said housing means into a tube aligned therewith; and flow control means continuously in communication with said high pressure section for providing high fluid pressure in said lance means and controlling fluid flow in said housing means, whereby a speed of said piston means and said lance means through said housing means is controlled.

2. The apparatus of claim 1 wherein said flow control means comprises means for controlling fluid flow from said high pressure section to said low pressure section, whereby said speed of said piston means and said lance means is controlled during an outward stroke thereof.

3. The apparatus of claim 2 wherein said fluid control means is characterized by an annulus defined between said piston means and said housing means.

4. The apparatus of claim 1 wherein said flow control means comprises means for controlling fluid flow from said low pressure section to a venting location, whereby said speed of said piston means and said lance means is controlled during an inward stroke thereof.

5. The apparatus of claim 4 further comprising housing outlet means on said housing means for defining a fluid outlet therein, and wherein said flow control means is characterized by:

venting means connected to said housing outlet means for providing communication between said low pressure section and said venting location; and means for adjusting the flow through said venting means.

6. The apparatus of claim 5 wherein said means for adjusting flow is characterized by a throttling valve.

7. The apparatus of claim 5 further comprising an orifice disposed in said venting means.

8. The apparatus of claim 4 wherein said flow control means is further characterized by said lance means defining a lance central opening therein and comprising port means for providing communication between said lance central opening and said high pressure section.

9. The apparatus of claim 8 wherein said port means is characterized by a plurality of substantially transverse holes in said lance adjacent to said piston means.

10. The apparatus of claim 1 further comprising sealing means for sealing between said piston means and said housing means.

11. A fluid powered tube jetting apparatus comprising: a housing comprising:

an inlet end portion;

an outlet end portion; and a tubular portion extending between said inlet and outlet end portions and connected thereto; a lance assembly comprising:

a piston slidably disposed in said housing such that inlet and outlet sections are defined in said housing on opposite sides of said piston, said piston defining a hole therethrough;

a tubular lance having an inner end connected to said piston and an outer end extending from said inlet end portion of said housing, said lance defining a plurality of ports therein adjacent said inner end thereof, such that said hole in said piston is in communication with said inlet section;

a jetting nozzle attached to said outer end of said lance;

an orifice disposed in said hole in said piston such that fluid flow from said inlet section to said outlet section is controlled; and a throttling valve connected to said outlet end portion such that fluid flow from said outlet section to a venting location is controlled.

12. The apparatus of claim 11, further comprising sealing means on said piston for sealing between said piston and said housing.

13. The apparatus of claim 11 further comprising sealing means for sealing between said outlet end of said housing and said lance.

14. The apparatus of claim 13 further comprising:

a lubricant seal spaced from said sealing means and adapted for sealingly engaging an outer surface of said lance; and lubricating means for lubricating between said sealing means and said lubricant seal.

15. The apparatus of claim 13 further comprising:

a seal support gland disposed outwardly of said sealing means;

a nut connected to said inlet end portion of said housing for holding said seal support gland; and venting for venting adjacent to said nut and preventing a pressure buildup thereacross.

16. The apparatus of claim 13 further comprising bearing means positioned on opposite sides of said sealing means for supporting and guiding said lance.

17. The apparatus of claim 11 wherein:

said outlet end portion has a first portion and a second portion and defines a pressure relief opening therein between said first and second portions;

whereby, as said lance assembly moves toward said outlet end portion of said housing during a return stroke, said piston passes from said first portion to said second portion of said outlet end portion such that said inlet section is in communication with said pressure relief opening.

18. The apparatus of claim 17 wherein said outlet end portion has an enlarged portion adjacent to said pressure relief opening.

19. The apparatus of claim 18 further comprising sealing means for sealing between said piston and housing except when aligned with said enlarged portion.

20. The apparatus of claim 17 further comprising a differential pressure relief valve comprising:

a relief valve housing defining a relief valve inlet in communication with said pressure relief opening in said outlet end portion of said housing, a reference pressure opening in communication with an outlet of said housing, and a relief valve outlet; and a poppet disposed in said relief valve housing and adapted for opening in response to a predetermined pressure differential between said relief valve inlet and said reference pressure opening.

21. The apparatus of claim 20 wherein said throttling valve is in communication with said relief valve outlet and said reference pressure opening.

22. The apparatus of claim 20 further comprising a foot valve in communication with said throttling valve.

23. The apparatus of claim 20 wherein said relief valve housing and said outlet end portion of said housing are substantially identical.

24. The apparatus of claim 11 further comprising means for limiting movement of said lance assembly on an outward stroke thereof.

25. The apparatus of claim 24 wherein said inlet end portion of said housing has a shoulder therein; and said means for limiting movement comprises:

a collet positioned at a predetermined location on said lance;

a collet support attached to said lance for holding said collet at said predetermined location; and a collet engaging sleeve adapted for engaging said collet and forcing said collet into gripping engagement with said lance when said sleeve engages said shoulder during said outward stroke of said lance assembly.

26. The apparatus of claim 25 wherein:

said collet has a tapered outer surface; and said sleeve has a corresponding tapered inner surface.

27. The apparatus of claim 25 wherein:

said collet has a tapered outer surface; and said collet support has a corresponding tapered inner surface.

28. The apparatus of claim 11 wherein a total cross-sectional area of said plurality of ports in said lance is greater than a cross-sectional area of a central opening of said lance.

29. The apparatus of claim 11 further comprising another orifice disposed between said throttling valve and said venting location.

30. An apparatus for cleaning interior surfaces of tubes, said apparatus comprising:

housing means for forming an enclosure;

housing inlet means on said housing means for defining a fluid inlet therein;

piston means for moving in said housing means such that a high pressure section in communication with said housing inlet means is defined in said housing means on one side of said piston means and a low pressure section is defined on an opposite side of said piston means.

lance means attached to said piston means for extending from said housing means into a tube aligned therewith; and flow control means for providing high fluid pressure in said lance means and controlling fluid flow in said housing means, whereby a speed of said piston means and said lance means through said housing means is controlled, said flow control means comprising means for controlling fluid flow from said high pressure section to said low pressure section, whereby said speed of said piston means and said lance means is controlled during an outward stroke thereof, said flow control means being characterized by:

said piston means defining a piston central opening therethrough;

said lance means defining a lance central opening therein in communication with said piston central opening and comprising port means for providing communication between said lance central opening and said high pressure section; and an orifice disposed in said piston central opening.

31. The apparatus of claim 30 wherein said port means is characterized by a plurality of substantially transverse holes in said lance adjacent to said piston means.

32. The apparatus of claim 30 wherein said port means has a cross-sectional area greater than a cross-sectional area of said lance central opening.

33. The apparatus of claim 30 wherein said orifice is interchangeable with other orifices.

34. An apparatus for cleaning interior surfaces of tubes, said apparatus comprising:

housing means for forming an enclosure;

housing inlet means on said housing means for defining a fluid inlet therein;

piston means for moving in said housing means such that a high pressure section in communication with said housing inlet means is defined in said housing means on one side of said piston means a low pressure section is defined on an opposite side of said piston means, said piston means comprising an outer surface defining a plurality of pressure balancing grooves therein;

lance means attached to said piston means for extending from said housing means into a tube aligned therewith; and flow control means for providing high fluid pressure in said lance means and controlling fluid flow in said housing means, whereby a speed of said piston means and said lance means through said housing means is controlled.

35. A jetting apparatus for cleaning interior surfaces of tubes, said apparatus comprising:

housing means for forming an enclosure;

housing inlet means on said housing means for defining a fluid outlet therein;

piston means for moving inwardly and outwardly in said housing means, said piston means being positioned in said housing means such that a high pressure section in communication with said housing inlet means is defined in said housing means on one side of said piston means and a low pressure section is defined on an opposite side of said piston means;

lance means attached to said piston means for extending from said housing means into a tube aligned therewith; and pressure relieving means for relieving pressure in said high pressure section as said piston means approaches an end of an inward stroke of said piston means, said pressure relieving means being characterized by an opening in said housing means, wherein said piston means passes said opening at said end of said inward stroke such that said opening is in communication with said high pressure section.

36. The apparatus of claim 35 wherein said pressure relieving means is in communication with said housing outlet means.

37. The apparatus of claim 35 further comprising sealing means for sealing between said piston means and housing means when said piston means is spaced from said pressure relieving means.

38. The apparatus of claim 35 wherein said pressure relieving means comprises a relief valve.

39. The apparatus of claim 38 wherein said relief valve comprises a differential pressure valve connected to said housing outlet means and said pressure relieving means.

40. The apparatus of claim 35 wherein said predetermined pressure is a differential pressure between said housing inlet means and said housing outlet means.

41. A tube jetting apparatus for cleaning interior surfaces of tubes, said apparatus comprising:

housing means for forming an enclosure, said housing means defining a housing central opening therein, said housing central opening having an enlarged portion;

housing inlet means on said housing means for defining a fluid inlet therein;

housing outlet means on said housing means for defining a fluid outlet therein;

piston means for moving inwardly and outwardly in said housing central opening of said housing means, said piston means being positioned in said housing means such that a high pressure section is defined in said housing means;

lance means attached to said piston means for extending from said housing means into a tube aligned therewith; and pressure relieving means for relieving pressure in said high pressure section as said piston means approaches an end of an inward stroke of said piston means, wherein said enlarged portion of said housing central opening is adjacent to said pressure relieving means.

42. The apparatus of claim 42 wherein said housing central opening has tapered portions on opposite sides of said enlarged portion.

43. The apparatus of claim 41 further comprising sealing means for sealing between said piston means and portions of said housing central opening spaced from said enlarged portion thereof, said sealing means being substantially disengaged from said housing means when aligned with said enlarged portion.

44. An apparatus for cleaning interior surfaces of tubes, said apparatus comprising:

housing means for forming an enclosure;

housing inlet means on said housing means for defining a fluid inlet therein;

housing outlet means on said housing means for defining a fluid outlet therein;

piston means for moving in said housing means such that a high pressure section in communication with said housing inlet means is defined in said housing means on one side of said piston means and a low pressure section is defined on an opposite side of said piston means;

lance means attached to said piston means for extending from said housing means into a tube aligned therewith;

flow control means in communication with said high pressure section for providing high fluid pressure in said lance means and controlling fluid flow in said housing means, whereby a speed of said piston means and said lance means through said housing means is controlled, said flow control means comprising means for controlling fluid flow from said low pressure section to a venting location, whereby said speed of said piston means and said lance means is controlled during an inward stroke thereof, and wherein said flow control means is characterized by:

venting means connected to said housing outlet means for providing communication between said low pressure section and said venting location; and means for adjusting the flow through said venting means; and an orifice disposed in said venting means, said orifice being interchangeable with other orifices.

45. An apparatus for cleaning interior surfaces of tubes, said apparatus comprising:

housing means for forming an enclosure;

housing inlet means on said housing means for defining a fluid inlet therein;

piston means for moving in said housing means such that a high pressure section in communication with said housing inlet means is defined in said housing means on one side of said piston means and a low pressure section is defined on an opposite side of said piston means;

lance means attached to said piston means for extending from said housing means into a tube aligned therewith, said lance means defining a lance central opening therein; and flow control means in communication with said high pressure section for providing high fluid pressure in said lance means and controlling fluid flow in said housing means, whereby a speed of said piston and said lance means through said housing means is controlled, said flow control means being further characterized by said lance central opening and comprising:

means for controlling fluid flow from said low pressure section to a venting location, whereby said speed of said piston means and said lance means is controlled during an inward stroke thereof; and port means for providing communication between said lance central opening and said high pressure section, wherein said port means has a cross-sectional area greater than a cross-sectional area of said lance central opening.

* * * * *